United States Patent [19]

Mårtensson et al.

[11] 4,054,074

[45] Oct. 18, 1977

[54] ARRANGEMENT FOR THE SEPARATION OF PACKING CONTAINERS

[75] Inventors: Kjell H. Mårtensson, Malmo; Stig A. Löthman, Sodra Sandby; Jan-Anders Holmgren, Arlov, all of Sweden

[73] Assignee: AB Ziristor, Lund, Sweden

[21] Appl. No.: 689,723

[22] Filed: May 25, 1976

[30] Foreign Application Priority Data

May 29, 1975 Sweden ..... 7506125

[51] Int. Cl.[2] ..... B65D 61/06; B26D 3/16; B26D 9/00; B26D 11/00

[52] U.S. Cl. ..... 83/622; 83/9; 83/54; 83/620; 83/623; 83/694; 93/33 R

[58] Field of Search ..... 53/182 M, 182 R, 389, 53/180 R; 83/1, 51, 9X, 54, 620, 694, 623, 695, 697, 622; 93/33 H, 33 R, 26, 19, 58.4, 58.3; 156/510

[56] References Cited

U.S. PATENT DOCUMENTS

| | | | |
|---|---|---|---|
| 2,091,795 | 8/1937 | Potdevin et al. | 93/33 R |
| 2,651,364 | 9/1953 | Ashman | 83/54 X |
| 2,687,174 | 8/1954 | Richens | 93/33 R |
| 3,417,545 | 12/1968 | Ljungberg | 53/182 M |
| 3,874,976 | 4/1975 | MacFarland, Jr. | 53/182 R X |

*Primary Examiner*—Travis S. McGehee

*Assistant Examiner*—Horace M. Culver

*Attorney, Agent, or Firm*—Pierce, Scheffler & Parket

[57] ABSTRACT

Parallelepipedic packing containers are made and filled in succession by passing a continuous web of packaging material over a forming device which converts the web into tubular form with an overlapped longitudinal seam. The tube is then filled with the intended contents, e.g., a liquid and is then divided off into individual packing containers by first pressing the tube transversely at longitudinally spaced intervals along broad zones and the opposite sides of the flattened tube are heat-sealed to each other along two narrow sealing regions close to the opposite base lines of the flattened zone while the remaining portions of the flattened zone remain non-sealed. The filled portion of the packing container between successive flattened zones is then reformed into the desired parallelepipedic shape, and the packages are then separated from each other by cutting through the non-sealed portion of the flattened zones thus leaving fins which are then folded down against the opposite side walls of the container to stiffen and reinforce the same. The cutting of the double-walled, non-sealed flattened zone is done quite closely to the narrow sealing regions and in such manner that the fins formed on each package have a single material thickness along substantially the full length of the sealing regions.

2 Claims, 5 Drawing Figures

ARRANGEMENT FOR THE SEPARATION OF PACKING CONTAINERS

Figure 1:
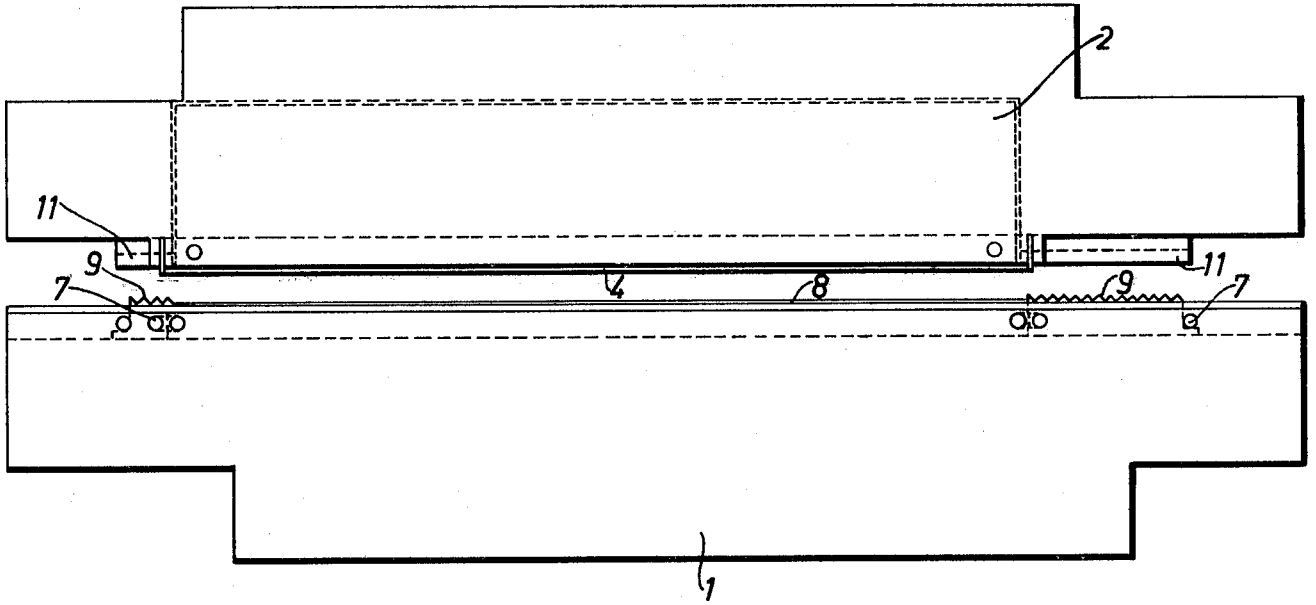

The present invention relates to an arrangement for the separation of packing containers manufactured from a continuous tube of packing material, which tube is divided into individual packing containers by repeated flattenings in preferably right-angled zones of the tube, extending transversely to the tube axis, along areas situated at a distance from one another, and sealing of parts of the said flattened areas, the separation being carried out by means of cuts through the non-sealed portions of the said flattened, double-walled zones.

It is known that packages can be made by first folding a web to a tube, whereupon the tube is filled with the intended contents and pressed flat and sealed along repeated zones which are arranged at a distance from one another. The finished, filled and sealed packing containers may then, after a possible shaping process, be separated from the tube by cuts in the said sealing zones, a so-called sealing fin being formed which is characteristic for packing containers of this type. Before or after the sealing the package may, as mentioned above, be shaped to e.g. parallelepipedic form, in which case the said sealing fins will extend along two opposite side walls and reach to the points of the triangular double-walled lugs which are formed when a tube section is formed to a parallelepipedic body. In the known packages it is endeavoured to fold down the sealing fins and the said triangular lugs against the wall surfaces of the package, and to fix at least the triangular lugs to these. It has been found, however, that the said sealing fins, on the one hand, have the disadvantage that they tend to get caught in one another during the transport and handling of the package containers, and that, on the other hand, they impart a less attractive appearance to the package. To overcome these disadvantages, the flattened sealing zones can be made so wide that they correspond to the width of the adjoining wall surfaces of the continuous packing containers. If in the separation of the packing containers from the tube the flattened fin is then divided into two parts of equal size, the width of each fin will correspond to half the width of the adjoining wall surface, which means that the fin, when it is turned over and folded down against its adjoining sidewall surface, will with its edge reach as far as the outer corner of the said wall surface, which has the effect that the sealing fin, when it is fixed to the sidewall surface, will strengthen and reinforce the said sidewall surface, whilst at the same time the negative impression of the sealing fin from a point of view of appearance is eliminated. The disadvantage of this method is, on the one hand, that the folded-down sealing fin, which comprises a double layer of material, will be thick and ungainly, and on the other hand that the increased consumption of material is uneconomical. This problem may be solved however, in such a manner that the flattened area between consecutive packing containers has a width corresponding to half the width of the adjoining sidewall surface, and that the greater part of the sealing fin is divided into parts comprising a single layer of material which can be sealed against the respective adjoining sidewall surface, whereby the above mentioned disadvantages are avoided and a reinforcing wall portion is obtained, which does not give the impression of a sealing fin, since it extends as far as the edge of the package wall panel, and, since the folded-down part comprises only one layer of packing material, the proposed solution, which has been made the subject of a separate patent application, is considerably more economical than the solution sketched out above.

To make it possible to achieve the solution aimed at, with the folded-down fin comprising only one material layer, a special separating element or separating arrangement has to be used, and the present patent application specifies such an arrangement, which is characterized in that the arrangement comprises two parts of a cutting tool acting together, each of which comprises a knife blade whose edge portion projecting from the front of the tool has a cutting depth which substantially corresponds to the thickness of one layer of the packing material intended for separation, corresponding to half the thickness of the said flattened area of the tube, the said knife blade being arranged so, when the parts of the cutting tool are pressed against one another, that they are parallel with but displaced in relation to one another.

Figure 2:
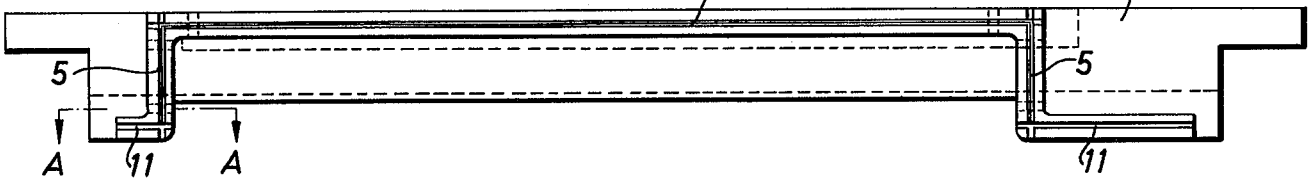
Figure 3:
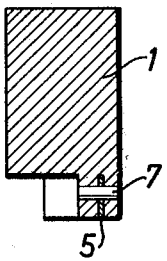
Figure 4:
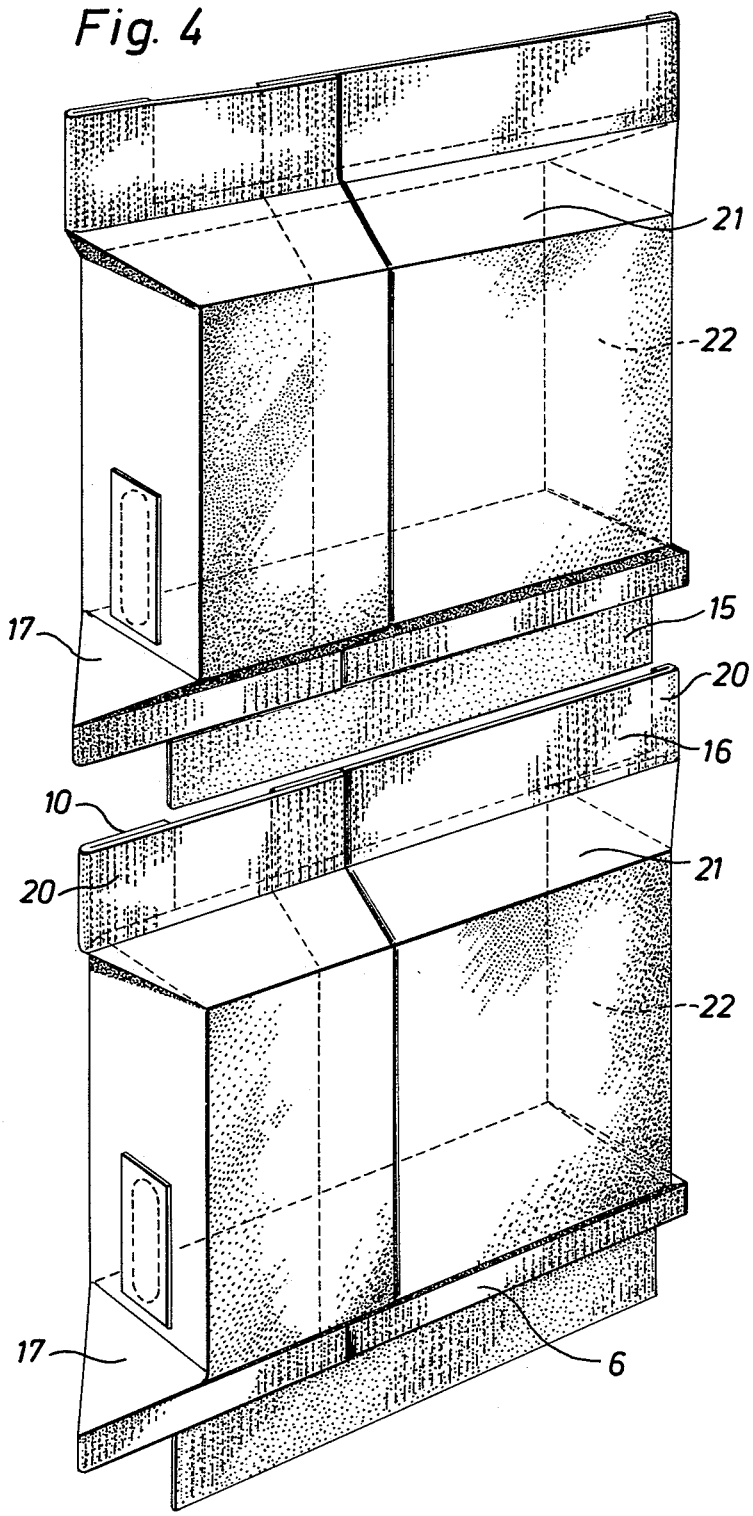
Figure 5:
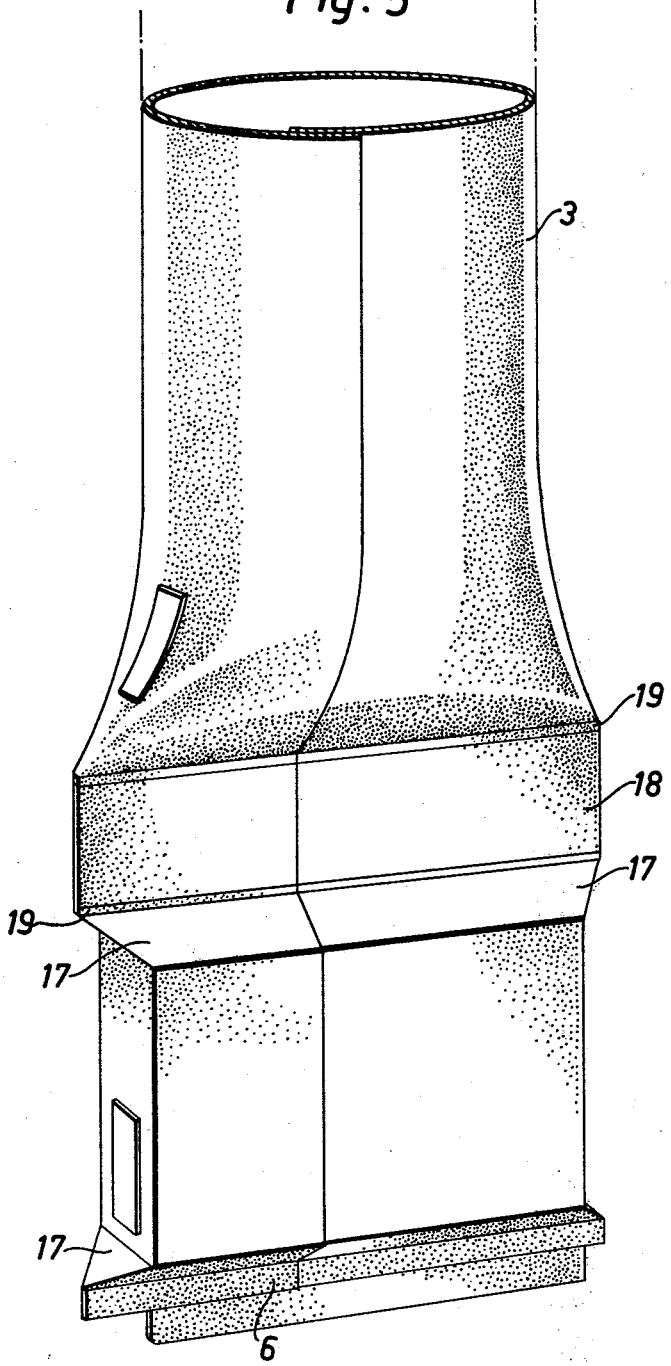

In the following an enbodiment of the invention will be described with reference to the enclosed schematic drawing, in which FIG. 1 shows a plan view of an arrangement comprising knife elements for the separation of packing containers in accordance with the invention, FIG. 2 shows a front elevation of the arrangement which is shown in FIG. 1, FIG. 3 shows a sectional view along the line A—A in FIG. 2, and FIG. 4 and 5 show packing containers which have been separated by means of the arrangement in accordance with the invention.

As can be seen from FIG. 1 the arrangement consists of two separate tool parts 1 and 2, which tool parts are arranged so as to operate as cutting elements when they are made to press against one another, whilst at the same time they take up between them a flattened portion of a tube of packing material, which tube is sealed along narrow sealing zones arranged on either side of the knife elements of the tool parts, whilst at least the area between the said knife elements is constituted of a non-sealed portion of the said flattened area of the tube. The sealing of the tube along the said narrow sealing zones, which have between them a flattened non-sealed area, can take place either in a working step before the separation of the sealed packing units, or else at the same time as the separation, and it is then also possible, advantageously, to combine the tool parts described here with sealing elements situated on the upperside and on the underside of the tool parts respectively. Since the said sealing elements do not have any direct, causal, connection with the separating device in accordance with the invention, the following description concentrates on the actual separating device, whilst it is assumed that the sealing elements may be carried out in an optional, known manner. Furthermore, no detailed description is furnished here of arrangements by means of which the tool parts 1 and 2 can be moved in relation to one another from an opened-out position, in which the tube of packing material can be advanced between the tool parts, to a cutting postion, in which the tool parts 1 and 2 are pressed against one another, taking up the tube between them.

The tool part 1, which appropriately consists of a rigid metal piece or a metal bar, has on its front face a straight knife 8, which at its ends changes into two knife parts 9 which have greater cutting depth than the knife part 8. In the case shown here, the knife parts 9 are not of equal length, but it may also be desirable to give them the same length. The important thing though is, that the cutting depth of the knife part 8 corresponds to the thickness of the packing material used, or, putting it in another way, to half the thickness of the flattened tube, which means that the knife 8 will cut through one layer of the packing material in the flattened but non-sealed zone between two successive packing units. The knife parts 9, on the other hand, have a cutting depth which corresponds to or exceeds the thickness of the flattened portion of the tube, which means that the flattened tube in the area of the knives 9 will be completely cut through. It should be mentioned, that the total length of the flattened part corresponds to or is a little less than the distance between the outer edges of the knife parts 9, which means that the outer edge parts of the flattened portion, where the material presents a folding line, will be completely cut through by the knife parts 9.

The tool part 2 comprises on the one hand a straight knife part 4 which in the working position of the separating device extends parallel with the knife part 8 of the tool part 1. The knife part 4, however, is displaced in relation to the knife part 8, so that in working position they will not be positioned right opposite one another. The length of the knife part 4 corresponds in principle to the length of the knife part 8. Beside the knife part 4, the tool part 2 comprises two further knife parts 5, which are arranged at right angles to the knife part 4 and in such a manner that at their ends they adjoin the knife part 4 so that a substantially continuous cutting or clipping line is obtained. The length of the knife parts 5 corresponds to the distance between the displaced knife parts 4 and 8 in such a manner, that the knife parts 5 in principle bridge the cutting lines or clipping lines which are obtained by the knife parts 4 and 8. The tool part 2 also comprises two grooves 11, which are arranged so as to receive the edge of the knife parts 9 of the tool part 1 when the two tool parts are pressed against one another. The reason for the presence of grooves 11 in the tool part 2 is, that the projecting edge portions of the knife parts 9 should not be damaged when the tool parts 1 and 2 are pressed against one another. The knife parts 4, 8 and 5 are appropriately manufactured as separate units from hardened special steel, which are fitted to the tool parts 1 and 2, for example, with the help of screws or guide pins 7, which can appropriately be arranged so that the position of the knives can be adjusted at least to some extent both in lateral direction and in the direction of depth.

For a better understanding of the operation of the arrangement two shaped packing containers are shown in FIG. 4, which have been separated with the help of the device in accordance with the invention, and in FIG. 5 the bottom part of a packing material tube 3 is shown, which has been flattened and sealed, and which is prepared for separation with the help of the arrangement in accordance with the invention.

In FIG. 5 is shown how a tube 3, by means of compression elements not shown here, is flattened within an area 18 and is sealed along narrow sealing zones 19, in such a manner that the greater part of the flattened area 18 remains non-sealed. After the sealing and flattening the shaping of the package takes place by means of optional shaping elements, not shown here, the sealed parts of the tubes being given, with the help of fold formation, a parallelepipedic shape. In this shaping, double-walled triangular lugs 17 are formed at the corner portions of the shaped packing containers, and, as can be seen from the figure, the sealing fins 6 formed extend over opposite sides of the packing container and reach as far as th points of the said lugs 17.

As mentioned previously, the separation can be carried out in connection with the flattening and sealing or in working step following the sealing operation, and the separation takes place so that the tool parts 1 and 2 described earlier are pressed against the flattened areas 18 of the tube 3, when the knife elements, which are arranged on the tool parts 1 and 2, will penetrate into the packing material and cut through the same to a depth corresponding to the cutting depth of the knife parts. In FIG. 4 are shown the packing containers separated by means of the arrangement, and it is evident from the figure, that the one edge 10 of the flattened fin is cut through fully and straiht, and this was done by the tool part 1, whilst, on the other hand, the other side of the same flattened fin, which is cut through with the help of the tool part 2, presents a lug-shaped portion 15, whose contour corresponds to the configuration of the knife parts 4 and 5 of the tool part 2. As can be seen from the figure, the main parts of the fins 15 and 16 comprise only one layer of material. However, the fin 16 comprises at its end parts 20 a doubled layer of material owing to the fins having been cut through with the help of the projecting parts 9 belonging to the knife part which is fitted onto the tool part 1. FIG. 4 will illustrate in an instructive manner the cutting function of the device, and in the present case the tool part 1 and its knife element have been dimensioned so that the longer of the knife parts 9 corresponds to the height of the triangular lugs 17, whilst the shorter part 9 is made in principle as short as possible. The reason for this is, that the triangular lugs 17, adjoining which the cut has been carried out with the help of the longer knife parts 9, are intended to be folded down against the side walls 21 of the package and fixed in this position, whilst, on the other hand, the remaining two lugs 17 are arranged to be folded in against that end walls of the package which are intended to form the base part 22 of the package. In this way it is ensured that no part of the inside of the separated flattened area is exposed when the lugs 17 are folded in against and are fixed to the side walls 21 of the packing container.

It is possible, in principle, to use separating elements comprising only two straight knives displaced in relation to one another, each of which only cuts through one layer of packing material, but in such a case special arrangements must be made for separating the packing material along the folding lines which are formmed when the said tube is flattened, since a part of the tube will not be separated if only two straight knives are used. It was found appropriate, however, to solve the problem in the manner described above, which gives a reliable cutting effect and hence a certain separation of the tube. Naturally it is possible within the scope of the invention to modify the concept of the arrangement in accordance with the invention, e.g. if the knives are designed curved instead of straight, if the attachment of the knives is modified or their dimensions are altered. The underlying idea of the invention, however, is the performance of a separating cutting action on either side of a flattened, non-sealed area of a tube, which area is limited on both sides by narrow sealing zones, in such a manner, that a fin of a substantially single thickness of packing material is formed, and that this process is carried out with the help of an arrangement comprising knives, the cutting depth or penetrating depth of which corresponds only to one thickness of packing material layer, and that the said knives are arranged to penetrate on both sides of the said flattened non-sealed area of the tube, but at a distance from one another.

We claim:

1. A cutting device for separating packing containers formed from a longitudinal tube-like member filled with a filling material and composed of a carton forming material, said tube-like member being provided with a plurality of spaced pairs of spaced transverse seals between opposed wall portions of the tube-like member to provide a series of interconnected packing containers, each pair of transverse seals having a transverse unsealed portion therebetween, said device comprising a first cutter member having a first knife blade extending parallel to the unsealed portion between a pair of transverse seals and terminating short of the ends of the unsealed portion, the depth of said first knife blade being substantially equal to the thickness of one layer of the carton forming material, said first knife blade having lateral extension blades extending at least to the lateral marginal edges of the unsealed portion with a depth not less than the thickness of two layers of the carton forming material, a second cutting member cooperable with said first cutting member and having a second knife blade extending parallel to the unsealed portion between the pairs of transverse seals and substantially coextensively with said first knife blade but spaced therefrom at right angles to said first knife blade, said second knife blade having extension blades at the ends of and at right angles to said second knife blade and extending substantially to the ends of said first knife blade and transversely of the unsealed portions, the depth of said second knife blade and right angular extension blades thereof being substantially equal to the thickness of one layer of the carton forming material, whereby when said first and second cutting members are pessed together with the unsealed portion therebetween to separate the packing containers, each separated portion of the unsealed portion will be provided with a central flap of a single layer of carton forming material, one separated section also being provided with lateral end portions of two thickness of the carton forming material.

2. A cutting device as claimed in claim 1 wherein said second cutting member is provided with grooves opposite the lateral extension blades of said first cutting member for receiving said lateral extension blades when cutting through the two layers of carton forming material.

* * * * *